US007975932B2

(12) United States Patent
Graf von der Schulenburg-Wolfsburg

(10) Patent No.: US 7,975,932 B2
(45) Date of Patent: Jul. 12, 2011

(54) TRACK STRUCTURE FOR RAILBORNE VEHICLES, PARTICULARLY TRAINS

(76) Inventor: Guenzel Graf von der Schulenburg-Wolfsburg, Wolfsburg-Nordsteimke (DE)

( * ) Notice: Subject to any disclaimer, the term of this patent is extended or adjusted under 35 U.S.C. 154(b) by 1305 days.

(21) Appl. No.: 10/559,279

(22) PCT Filed: Jun. 3, 2004

(86) PCT No.: PCT/DE2004/001156

§ 371 (c)(1),
(2), (4) Date: Dec. 2, 2005

(87) PCT Pub. No.: WO2004/109016

PCT Pub. Date: Dec. 16, 2004

(65) Prior Publication Data

US 2006/0131436 A1 Jun. 22, 2006

(30) Foreign Application Priority Data

Jun. 4, 2003 (DE) ..... 103 25 166

(51) Int. Cl.
*E01B 1/00* (2006.01)

(52) U.S. Cl. ..... 238/7

(58) Field of Classification Search ..... 104/124; 232/3, 5, 6, 2, 7

See application file for complete search history.

(56) References Cited

U.S. PATENT DOCUMENTS

| | | | | |
|---|---|---|---|---|
| 4,142,468 | A * | 3/1979 | Birnstiel | 104/124 |
| 4,652,495 | A * | 3/1987 | Sato et al. | 428/425.5 |
| 4,964,750 | A * | 10/1990 | House et al. | 404/6 |
| 5,486,071 | A * | 1/1996 | Bullivant | 405/229 |
| 5,653,388 | A * | 8/1997 | Pietschmann et al. | 238/7 |
| 5,776,243 | A * | 7/1998 | Goodson et al. | 106/677 |
| 6,151,858 | A * | 11/2000 | Ruiz et al. | 52/481.1 |
| 6,668,729 | B1 * | 12/2003 | Richards | 104/124 |
| 7,820,094 | B2 * | 10/2010 | Ladely (Guevara) et al. | 264/333 |

FOREIGN PATENT DOCUMENTS

| | | |
|---|---|---|
| AT | 390 976 B | 7/1990 |
| DE | 4133905 | 5/1992 |
| DE | 43 09 392 A | 9/1994 |
| DE | 100 04 194 A | 8/2001 |
| DE | 100 04 626 A | 8/2001 |
| EP | 0 456 147 A | 11/1991 |
| EP | 663470 | 7/1995 |
| EP | 1 258 563 A | 11/2002 |
| EP | 1 644 581 B1 | 11/2006 |

OTHER PUBLICATIONS

"Stand der technologischen Entwicklungen zu festen Fahrbahnen und deren Anwendung", Eisenbahningenieur 34 (1983) 3, pp. 97-104.

English language Abstract of EP 663470.

English language Abstract of DE 4133905.

International Search Report dated Oct. 5, 2004 for I.A. PCT/DE2004/001156.

* cited by examiner

*Primary Examiner* — S. Joseph Morano
*Assistant Examiner* — R. J. McCarry, Jr.
(74) *Attorney, Agent, or Firm* — Andrew M. Calderon; Roberts Mlotkowski Safran & Cole, P.C.

(57) ABSTRACT

A track structure for railborne vehicles comprising a bed on which rails fastened to sleepers are seated. The structure comprises a concrete trough seated on a substructure and having walls extending in the longitudinal direction. The side walls are spaced apart parallel to one another at least by a sleeper length. A method of manufacturing of the structure is also provided.

16 Claims, 2 Drawing Sheets

TRACK STRUCTURE FOR RAILBORNE VEHICLES, PARTICULARLY TRAINS

FIELD OF INVENTION

The invention relates to a track structure for railborne vehicles, particularly trains, comprising a bed on which rails fastened to sleepers are seated.

BACKGROUND DESCRIPTION

A ballast bed, which generally consists of weather-resistant hard rock (for example basalt) in various particle sizes depending on the track loading, is first formed for this track structure. The standard depth of ballast to the bottom edge of the sleeper is 30 cm. Rails or rail sections connected to concrete or wooden sleepers are placed on this ballast bed. Track-tamping machines are used to push ballast under the sleepers. These machines are equipped with hydraulically controlled picks which press the ballast under the sleepers. In order to allow rainwater to flow off and to prevent the rails lying under water, the ballast bed has to be regularly cleared of foreign matter. For this purpose, the ballast has to be lifted up, screened and then placed back on the track bed. It then has to be tamped again. Laying the rails and maintaining the track bed are therefore time-consuming and cost-intensive operations.

SUMMARY OF THE INVENTION

Taking this problem as the departure point, the intention is to improve the track structure described at the beginning such that the rail sections can be laid in a simple and cost-effective manner and the time required for maintenance work is reduced. In addition, the track structure should ensure maximum noise reduction.

To solve the problem, the generic track structure is distinguished by the fact that the bed consists of a concrete trough seated on a substructure and having side walls extending in the longitudinal direction, and by the fact that the side walls are spaced apart parallel to one another at least by the sleeper length.

This design makes it possible to dispense completely with the ballast bed. The side walls take over the lateral retention of the sleepers. Laying the rail sections is considerably simplified because they have only to be fitted into the concrete trough. Tamping is dispensed with completely. Foreign matter accumulating over time can be removed simply by suction. Maintenance work can thus be carried out in a substantially simple and cost-effective manner. It should be assumed with regard to this track structure that lightweight materials, such as, for example, leaves, are automatically removed from the track bed by the suction action of fast-moving trains. Moreover, the maintenance intervals are extended even further as a result. Worn or damaged rail parts can be replaced in a simple manner.

The substructure is preferably cast in situ from lightweight concrete, in particular foamed concrete. Expansion joints are not absolutely necessary. The concrete trough preferably consists of steel-reinforced foamed concrete. Foamed concrete is also referred to as cellular concrete. The steel-reinforced concrete trough is placed on the substructure. If appropriate, it may be laterally covered with soil. The use of foamed concrete affords high sound-absorbing values, thereby reducing the noise generated by trains as they move past.

The substructure has a density of 400-650 kg/m$^3$, particularly preferably 450 kg/m$^3$. The concrete trough preferably has a density of 1100-1900 kg/m$^3$, in particular 1500 kg/m$^3$.

Having the rails protrude beyond the side walls in the vertical direction ensures that the rail surface is freely accessible to traffic even when there are considerable amounts of precipitation and that the vehicle wheels do not travel through accumulated water.

If the parallel spacing between the side walls corresponds to the sleeper length, the rail sections are automatically centered upon fitting.

To ensure that rainwater or melt water can be quickly drained from the track structure, the side walls of the concrete trough are preferably provided with a multiplicity of wall openings into which pipes are particularly preferably inserted.

At least one empty pipe is integrated into the substructure so that supply lines or the like can be laid at some later time.

It is particularly advantageous if the concrete trough consists of individual prefabricated segments which can be placed on the substructure produced in situ and connected to one another. The production of the track structure is thus further simplified and the construction time further reduced. Moreover, individual segments may be easily replaced if required, thereby reducing the maintenance costs.

To enable the individual segments to be aligned with one another and fixed laterally, the base of each segment is provided at its ends with a central slot or a cutout into which can be fitted an insert which is preferably T-shaped in cross section. This insert prevents the segments from drifting apart laterally.

The method of producing a track structure for railborne vehicles, particularly trains, is distinguished by the following steps:

a) casting a substructure from a lightweight concrete, in particular a foamed concrete having a (dry) density of 400-700 kg/m$^3$;
b) placing prefabricated trough segments on the substructure to form a concrete trough having side walls extending in the longitudinal direction;
c) aligning the trough segments with one another;
d) fitting rail sections fastened to sleepers between the side walls.

Inserts are preferably fitted into central slots provided in the base of the trough segments to center the segments and secure the butt joint against lateral displacement.

BRIEF DESCRIPTION OF THE DRAWINGS

An exemplary embodiment of the invention will be described in more detail below with the aid of a drawing, in which.

DETAILED DESCRIPTION OF THE INVENTION

The track structure consists of the substructure 5, which is cast in situ from lightweight concrete, in particular foamed concrete, as produced for example by the Canadian company Cematrix. Standard shuttering is necessary for this purpose. The foamed concrete can be mixed in situ. Foaming is induced using bubble-forming substances (blowing in air). Integrated into the substructure 5 is at least one empty pipe 6 through which supply lines can be drawn at some later time. The substructure 5 is provided with slightly upwardly extended side walls 5*a*, 5*b*. The use of foamed concrete is common in roadbuilding. Foamed concrete is distinguished by good sound-absorbing properties and high thermal insulation.

Prefabricated segments S consisting of reinforced concrete are fitted between the side walls 5*a*, 5*b*. A plurality of segments S laid against one another form a concrete trough 4 having a base 4*c* and the side walls 4*a*, 4*b* which point in the vertical direction. The width of the segment S is chosen so that it can be fitted exactly between the side walls 5*a*, 5*b* of the substructure 5, thereby preventing lateral displacement of the concrete trough 4. The segments (S) are produced in a length of 5-15 m.

Figure 1:
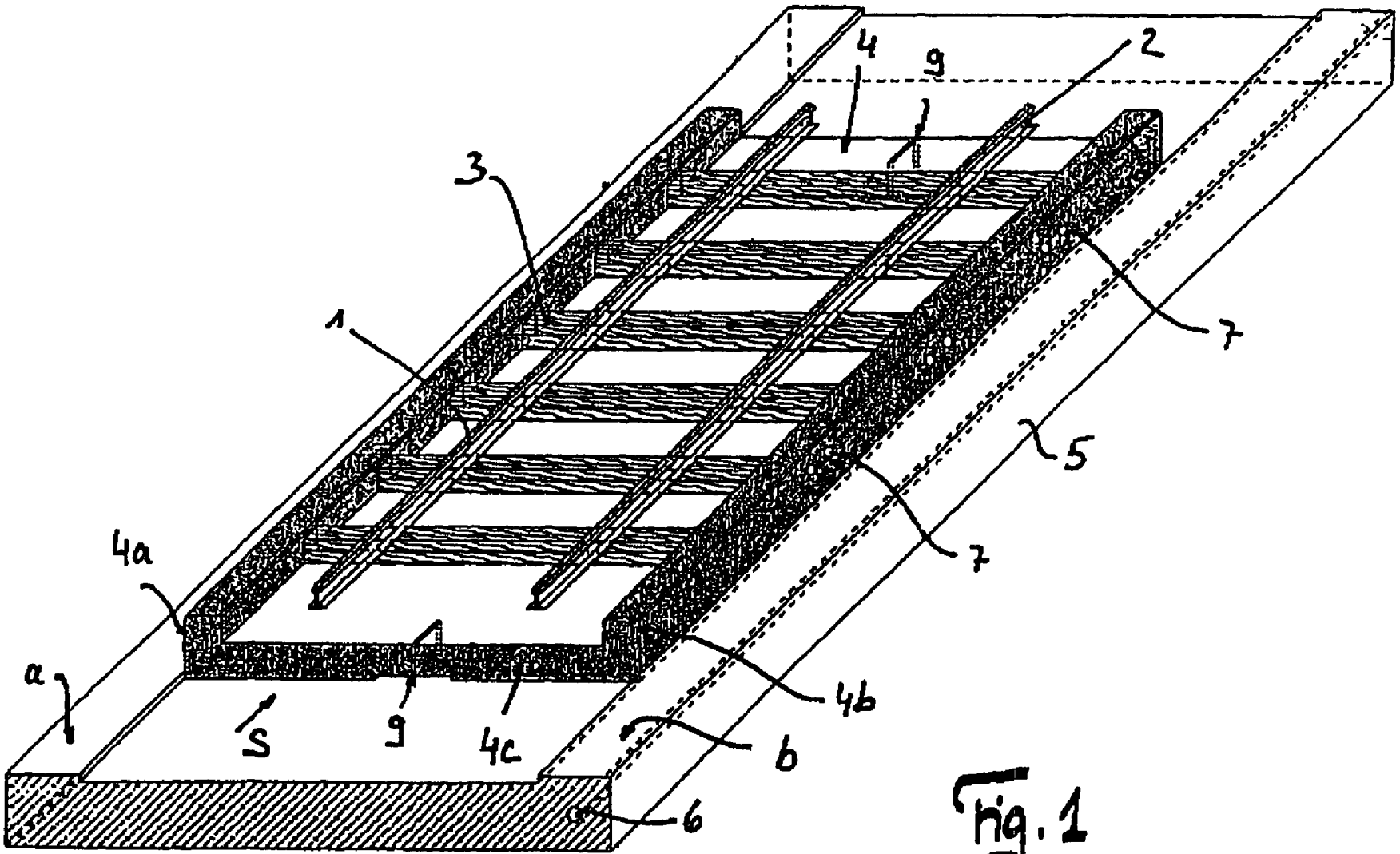
FIG. 1 shows a perspective view of the track structure.
Figure 2:
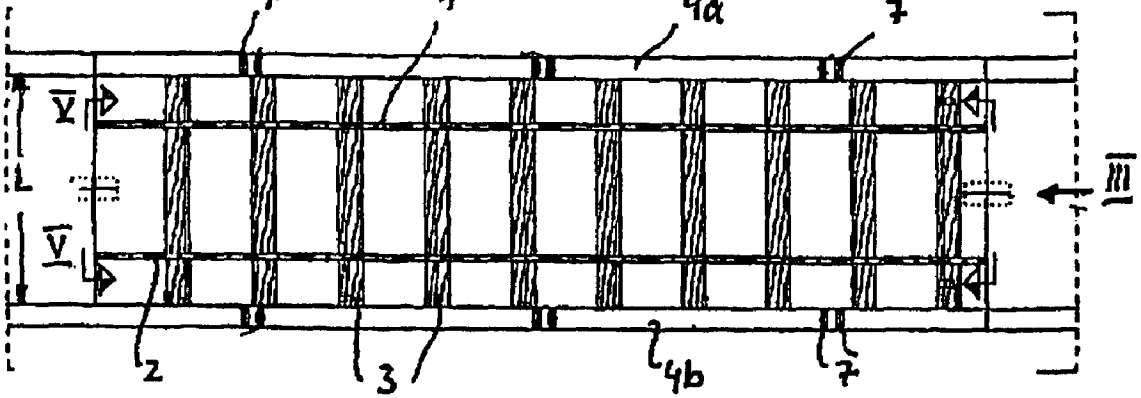
FIG. 2 shows the plan view of a track structure.
Figure 3:
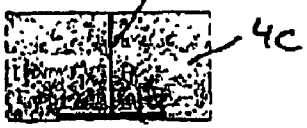
FIG. 3 shows a partial representation of the concrete trough in the direction of view arrow III according to FIG. 2.
Figure 4:
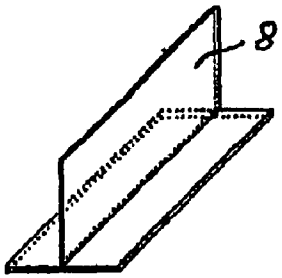
FIG. 4 shows an insert in a perspective representation.
Figure 4A:
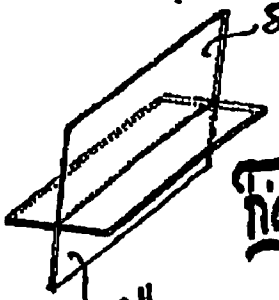
FIG. 4*a* shows a further insert in a perspective representation.

A multiplicity of openings 7 into which pipes are inserted are provided in the side walls 4*a*, 4*b* of each segment 4, thereby allowing water which accumulates in the trough 4 to run off to the outside. The segment S is provided at both its ends with a cutout or a slot 9 which is arranged centrally in the base 4*c*. An insert 8 of T-shaped cross section can be fitted into this cutout 9. Two abutting segments S are aligned with one another and fixed laterally via this insert 8, thereby making it possible for the butt joint to be secured. The butt joint can be better secured using the insert 8' of cruciform cross section shown in FIG. 4*a*. The additional leg 8" can be driven into or inserted into the substructure 5.

The prefabricated segments S are placed individually on the substructure 5 so that they adjoin one another. Rail sections 1, 2 fastened to concrete or wooden sleepers 3 are fitted into the concrete trough 4. The inside dimension between the side walls 4*a*, 4*b* of the trough 5 corresponds to the length L of the sleepers 3, with the result that the concrete trough 4 is responsible for laterally guiding the rail sections 1, 2.

Figure 5:
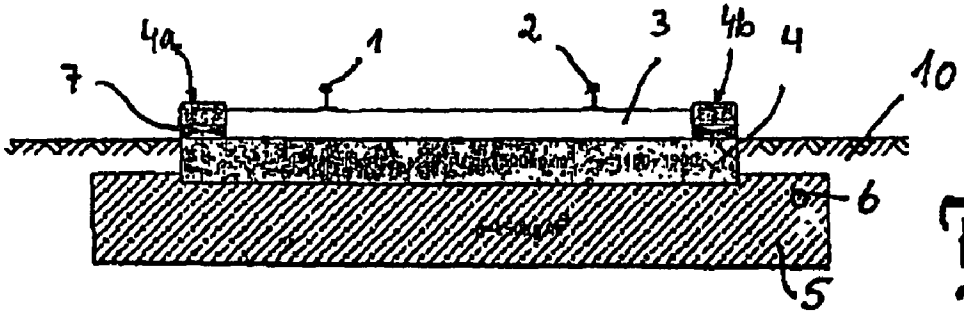
FIG. 5 shows the section along the line V-V according to FIG. 2.

As can be observed from FIG. 5, the side walls 4*a*, 4*b* of the trough 4 are designed to be somewhat higher than the thickness of the sleepers 3, with the result that the sleepers are sunk completely into the trough, whereas the rail sections 1, 2 fastened to the sleepers 3 protrude beyond the trough 4. Soil 10 which covers the substructure 5 is piled laterally against the trough 4.

The substructure 5 preferably consists of nonreinforced lightweight concrete having a density of 400-700 kg/m$^3$. Good results have been obtained with a density of 450 to 650 kg/m$^3$. The trough 4 consists of reinforced concrete comprising galvanized reinforcement and having a density of 1100-1900 kg/m$^3$, good results having been achieved with a density of 1500 kg/m$^3$.

LIST OF REFERENCES

1 rail/rail section
2 rail/rail section
3 sleeper
4 concrete trough/trough
4*a* side wall
4*b* side wall
4*c* base
5 substructure
5*a* side wall
5*b* side wall
6 empty pipe
7 opening
8 insert
8' insert
8" leg
9 slot/cutout
10 soil
L sleeper length
S segment

The invention claimed is:

1. A track structure for railborne vehicles comprising a bed on which rails fastened to sleepers are seated, the bed comprising a concrete trough seated on a substructure and having side walls extending in a longitudinal direction, and the side walls are spaced apart parallel to one another at least by a sleeper length, wherein the rails protrude beyond the side walls in a vertical direction, the concrete trough comprises steel-reinforced foamed concrete, the side walls are higher than the sleepers, the substructure has a density of 400-700 kg/m$^3$, and the concrete trough has a density of 1100-1900 kg/m$^3$.

2. The track structure as claimed in claim 1, wherein the side walls are provided with a multiplicity of wall openings.

3. The track structure as claimed in claim 1, wherein the sleepers contact the concrete trough.

4. A track structure for railborne vehicles comprising a bed on which rails fastened to sleepers are seated, the bed comprising a concrete trough seated on a substructure and having side walls extending in a longitudinal direction, and the side walls are spaced apart parallel to one another at least by a sleeper length, wherein the concrete trough includes individual segments, and a base of each segment is provided at both ends with a central slot or a cutout, further comprising an insert fitted into the slot to center the segments, wherein the insert is T-shaped in cross section.

5. A method of producing a track structure for railborne vehicles comprising:

a) casting a substructure from a lightweight concrete;

b) placing prefabricated trough segments on the substructure to form a concrete trough having side walls extending in a longitudinal direction;

c) aligning the trough segments with one another; and d) fitting rail sections fastened to sleepers seated on and contacting the concrete trough and between the side walls of the concrete trough, further comprising fitting inserts into central slots in a base to center the segments and secure a butt joint against lateral displacement.

6. The method as claimed in claim 5, wherein the casting of the substructure is from foamed concrete having a (dry) density of 400-700 kg/m$^3$.

7. The method as claimed in claim 5, wherein a spacing between the side walls of the concrete trough corresponds to a length of the sleepers.

8. The method as claimed in claim 5, wherein the rails protrude beyond the side walls in a vertical direction.

9. The method of claim 5, wherein the side walls are higher than the sleepers such that the sleepers are sunk completely into the concrete trough.

10. The method of claim 5, wherein the substructure comprises upwardly extending side walls that prevent lateral displacement of the concrete trough.

11. A method of producing a track structure for railborne vehicles comprising:

a) casting a substructure from a lightweight concrete;

b) placing prefabricated trough segments on the substructure to form a concrete trough having side walls extending in a longitudinal direction;

c) aligning the trough segments with one another; and d) fitting rail sections fastened to sleepers seated on and contacting the concrete trough and between the side walls of the concrete trough, wherein a base of each segment is provided at both ends with a central slot or a cutout.

12. The method as claimed in claim 11, further comprising an insert fitted into the slot to center the segments.

13. The method as claimed in claim 12, wherein the insert is T-shaped in cross section.

14. A track structure for railborne vehicles comprising a bed on which rails fastened to sleepers are seated, the bed comprising a concrete trough seated on a substructure and having side walls extending in a longitudinal direction, and the side walls are spaced apart parallel to one another at least by a sleeper length, wherein the rails protrude beyond the side walls in a vertical direction, the concrete trough comprises prefabricated trough segments which are aligned with one another, the substructure comprises a lightweight foamed concrete and has a density of 400-700 kg/m$^3$, the concrete trough has a density of 1100-1900 kg/m$^3$, and the trough segments include fitted inserts in slots at both ends to center the trough segments and secure a butt joint against lateral displacement.

15. The track structure as claimed in claim 14, wherein the insert is T-shaped in cross section.

16. The track structure as claim 14, wherein the trough segments are steel reinforced.

* * * * *